United States Patent [19]

Cohen

[11] Patent Number: 4,703,708

[45] Date of Patent: Nov. 3, 1987

[54] STEERABLE KEEL

[76] Inventor: Daniel L. Cohen, 3330 S. Robertson Blvd., Los Angeles, Calif. 90034

[21] Appl. No.: 885,562

[22] PCT Filed: Jul. 29, 1985

[86] PCT No.: PCT/US85/01419

§ 371 Date: Dec. 30, 1985

§ 102(e) Date: Dec. 30, 1985

[51] Int. Cl.[4] ..... B63B 41/00

[52] U.S. Cl. ..... 114/141; 114/138

[58] Field of Search ..... 114/140–143, 114/126–128, 138, 139, 149, 227, 169; 440/112

[56] References Cited

U.S. PATENT DOCUMENTS

| | | | |
|---|---|---|---|
| 433,955 | 8/1890 | McPartland | 114/128 |
| 768,085 | 8/1904 | Stromberg | 114/128 |
| 3,946,693 | 3/1976 | Brown | 114/128 |
| 3,990,384 | 11/1976 | Reynolds | 114/149 |
| 4,000,933 | 1/1977 | Derman | 440/112 |
| 4,067,280 | 1/1978 | Serfess | 114/128 |
| 4,226,206 | 10/1980 | Wilson | 440/112 |
| 4,316,425 | 2/1982 | Guido | 114/141 |
| 4,376,416 | 3/1983 | Carver | 114/141 |
| 4,543,069 | 9/1985 | Koayashi | 440/51 |
| 4,563,971 | 1/1986 | Carver | 114/141 |

FOREIGN PATENT DOCUMENTS

| | | | |
|---|---|---|---|
| 2421796 | 11/1979 | France | 114/141 |

*Primary Examiner*—Joseph F. Peters, Jr.
*Assistant Examiner*—Clifford T. Bartz
*Attorney, Agent, or Firm*—Albert O. Cota

[57] ABSTRACT

A steerable keel (10) comprising, in a first embodiment, a stationary section (12) and a rotatable section (14) and in a second embodiment, a stationary section (30) and two rotatable sections (32) (34). In either embodiment, the steerable keel (10) is designed with an aerodynamic fin cross-section and extends downwardly in a vertical direction from the hull of a sail boat (50). The rotatable sections (12) or (32) (34) are in indpendently controlled by a tiller(s) located above the boat deck. The keel (10) in operation is fixed. However, a means is provided to retract the keel to allow the boat to dock and navigate through shallow waters. The steerable keel (10) is designed to equalize the wind force and its below water keel counter force by providing a controlled below water lifting force that is produced by selectively adjusting the arc travel of the rotatable keel(s). Thus, the boat beam is maintained in a relatively horizontal plane which, in turn, allows a greater speed to be achieved.

16 Claims, 17 Drawing Figures

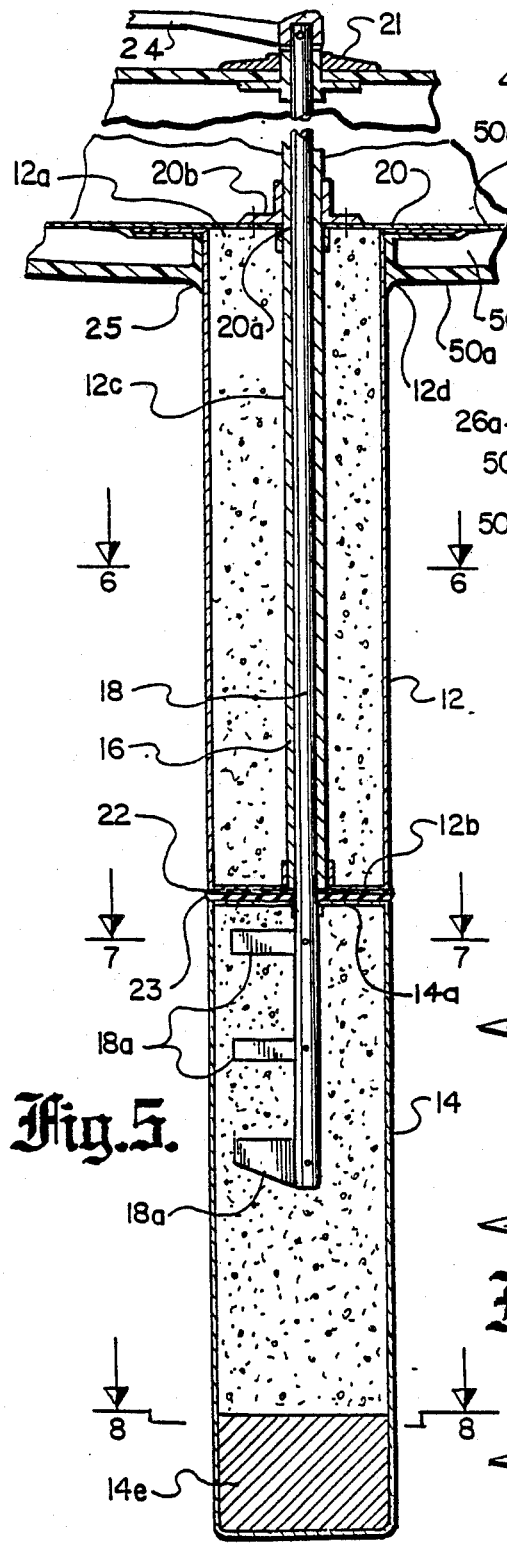
Fig.5.
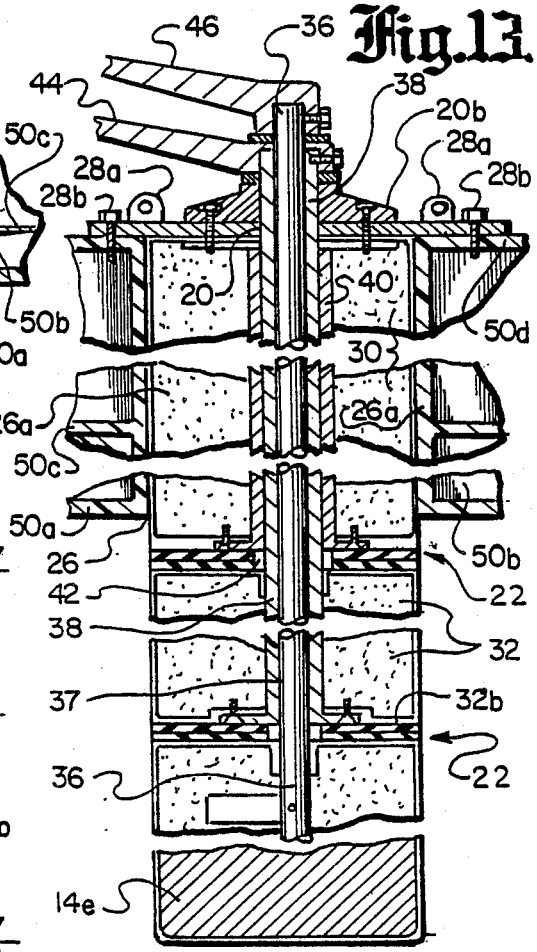
Fig.13.
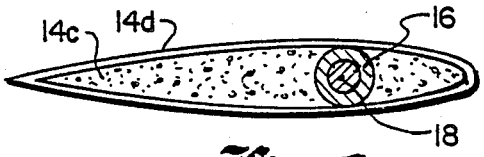
Fig.6.
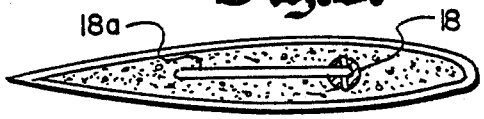
Fig.7.
Fig.8.
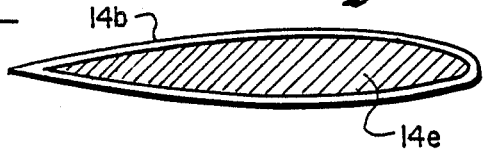

STEERABLE KEEL

TECHNICAL FIELD

The invention pertains to the general field of sailing boat keels and more particularly to a keel having a stationary keel section and one or two rotatable sections that are independently controlled from the boat deck.

BACKGROUND ART

The art of designing keels for sailing boats has progressed from weighted bulky structures as used on ancient reed boats and Columbian era boats to todays keel designs that employ aerodynamic fins.

Current fin keels are basically designed to achieve optimum laterial resistance with minimum drag and to optimize the aspect ratio of the keel so that the heeling forces are minimized. The resulting drag curve for these current designs is very steep at speeds between 5 to 8 knots. Therefore, the upwind speed is severly limited. In general, it can be said that prior art keels are designed primarily for boat stability rather than to achieve an increase in speed.

A search of the prior art did not disclose any patents that read directly on the invention. However, the following U.S. patents are considered related and indicative of the prior art:

| PATENT NUMBER | INVENTOR | ISSUED |
|---|---|---|
| 768,085 | Stromborg | 23 August 1904 |
| 398,900 | Martin | 5 March 1889 |
| 367,771 | Witmer | 2 August 1887 |

The Stromborg patent discloses a double-balancing safety-keel apparatus for use on sailing vessels. The apparatus is comprised of two vertically stacked fins or blades that pivot about a vertical axis located at the longitudinal center of the vessel. Each blade may be horizontally rotated on its axis independently of the other or both may be rotated or tuned simultaneously.

The Martin patent develops a steering gear apparatus for use on small sailing vessels. The apparatus is comprised of two in-line blades that are designed to be used both as rudders and centerboards. One blade is located at the aft end and the other at the forward end. Each blade may be extended or retracted independently of the other and the blades may be operated together or singularly. When the vessel is running before the wind, the forward blade would be retracted out-of-use leaving the aft blade to serve as the sole rudder.

The Witmer patent discloses a combined double-action steering and braking apparatus for use on sailing vessels. The apparatus is comprised of two retractable rudders, one located near the forward end and the other near the stem of the vessel. The posts of the rudders are connected by cross-cables so that both rudders may be operated simultaneously. When the rudders are turned, with respect to the centerline of the keel, they function as conventional steering rudders. However, when they are positioned normal to the keel a breaking action is produced.

DISCLOSURE OF THE INVENTION

The steerable keel is presented in two embodiments, the first is a keel design employing an upper stationary section and one rotatable section while the second embodiment has an upper stationary section and two rotatable sections. In either design the amount of rotation desired is independently controlled by a tiller or set of tillers depending on the embodiment. The keels in either case have an aerodynamic foil cross-section and extend below the boat hull for a total of 12 feet (3.66 meters). Because of this length a means is provided that allows the steerable keel to be retracted to allow the boat to dock and navigate is shallow waters.

The steerable keel is designed to be used with sailing boats and in particular high-speed sailing boats. The purpose of the keel and its primary object is to maintain lateral stability and thus gain an increase in speed. Lateral stability is achieved when the keel produces a below water lifting force that tends to equalize the wind force and the reacting below water counterforce on the keel. The amount of equalizing force applied is dependent on the amount of boat heel, the wind force and the sail conditions. Whatever the level of the applied force, it is controlled by selectively setting the arc travel of the rotatable section(s).

In addition to the primary object of achieving stability with an increase in speed, it is also an object of the invention to have a steerable keel that:

can be easily manufactured from a variety of material, is reliable and easily maintained, and can be custon designed with various widths and lengths to accommodate various hull sizes and hull shapes.

BRIEF DESCRIPTION OF THE DRAWINGS

FIG. 5 is a cutaway side view of a typical mounting configuration for a steerable keel having an upper stationary section and a lower rotatable section.

FIG. 6 is a sectional view taken along line 6—6 of FIG. 5.

FIG. 7 is a sectional view taken along line 7—7 of FIG. 5.

FIG. 8 is a sectional view taken along lines 8—8 of FIG. 7.

FIG. 13 is a cutaway side view of a typical stationary and retractable steering keel having an upper stationary section, a middle rotatable section and a lower rotatable section.

BEST MODE FOR CARRYING OUT THE INVENTION

Figure 1:
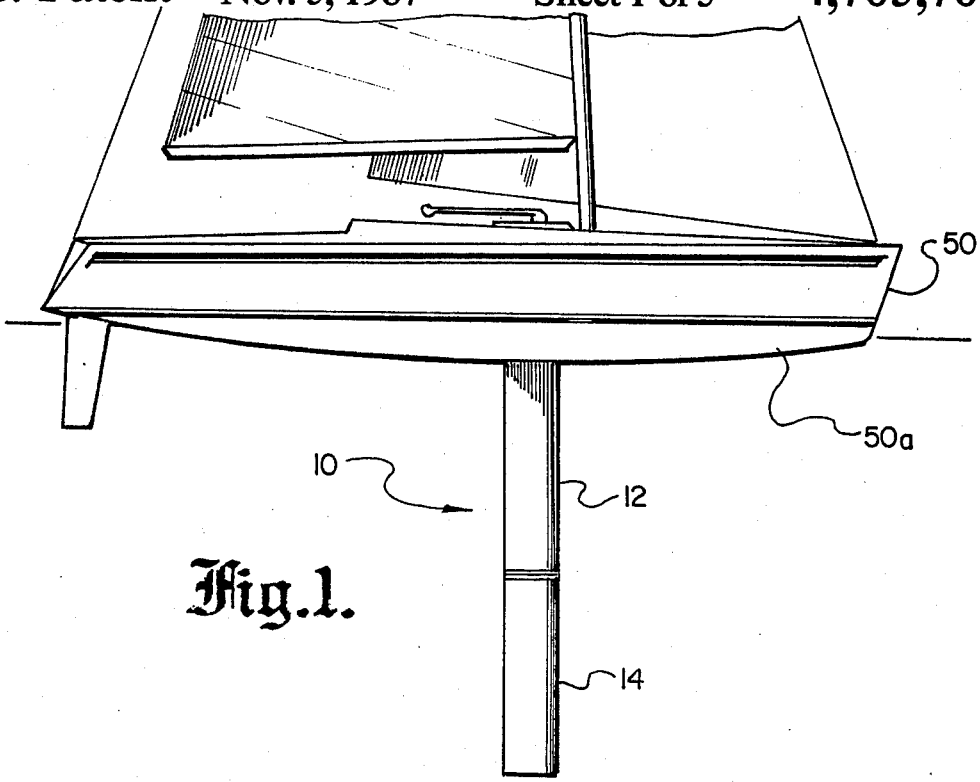
FIG. 1 is a sideview of a sailing boat having a steerable keel with a upper stationary section and a single lower rotatable section.
Figure 2:
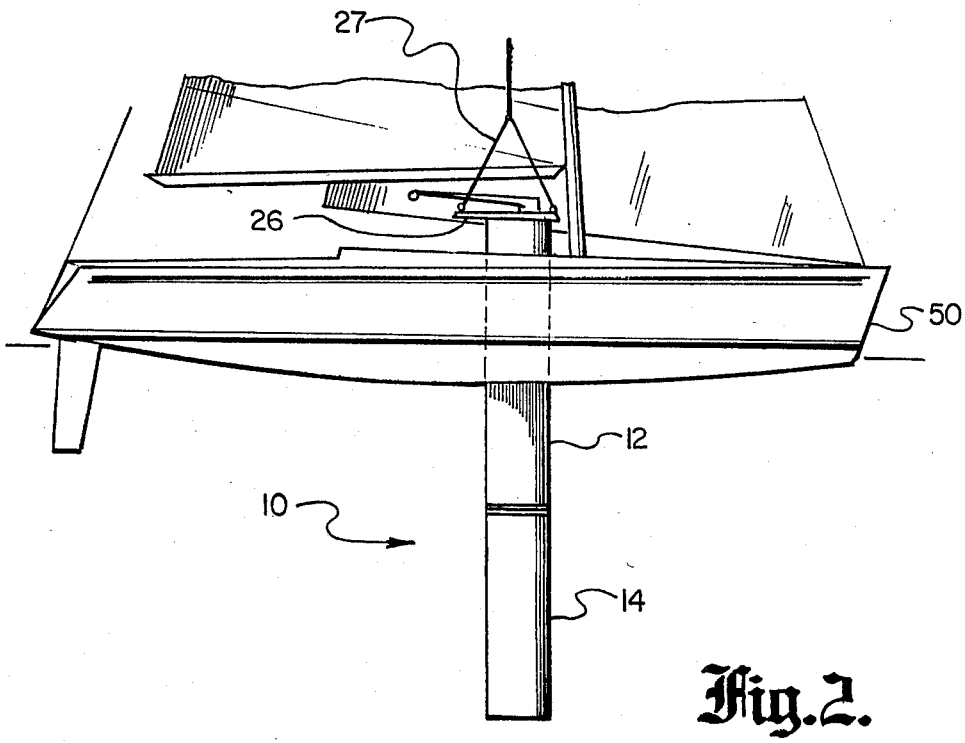
FIG. 2 is a sideview of a sailing boat having a retractable steerable keel with an upper stationary section and a single rotatable lower section.
Figure 4:
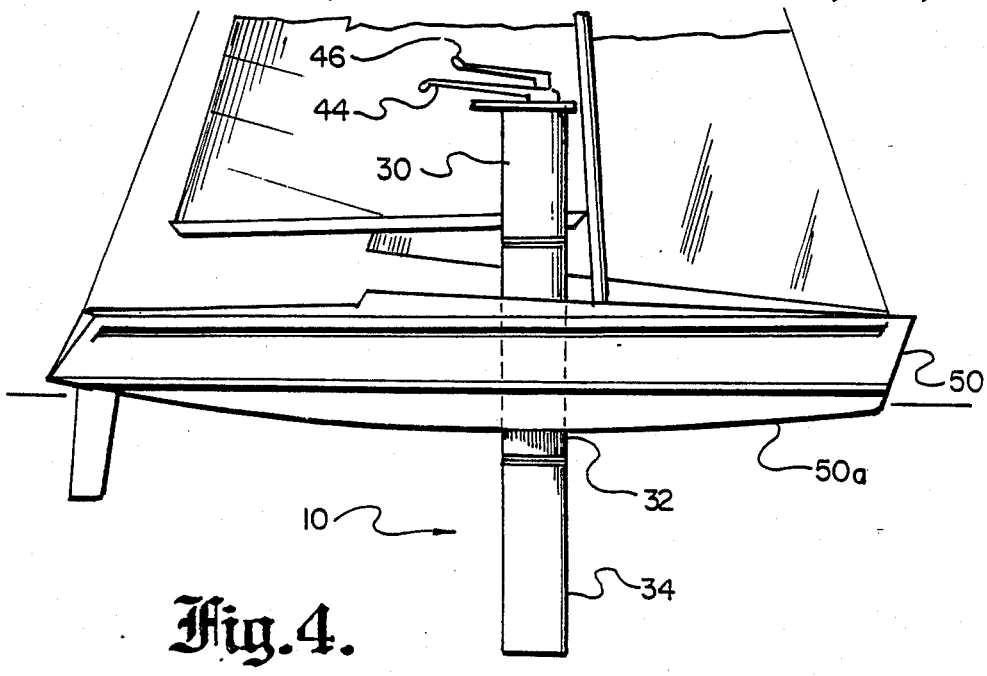
FIG. 4 is a sideview of a sailing boat having a retractable steering keel with an upper stationary section, a middle rotatable upper section and a lower rotatable section.
Figure 3:
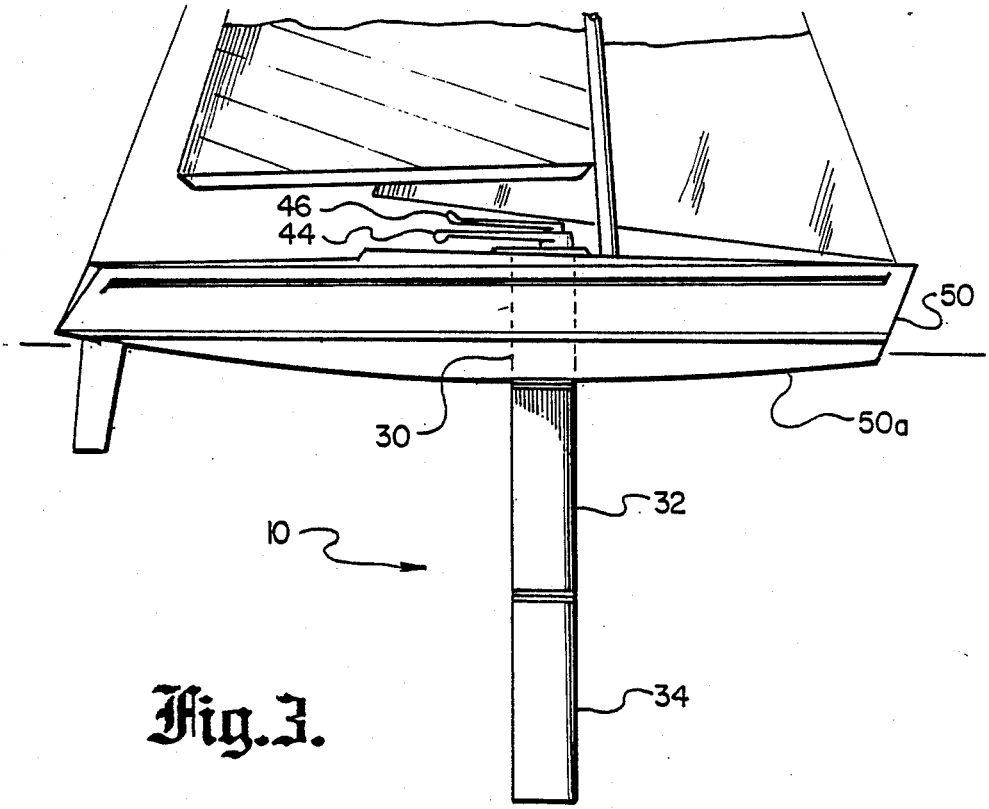
FIG. 3 is a sideview of a sailing boat having a steerable keel with an upper stationary section, a middle rotatable section and a lower rotatable section.

The best mode for carrying out the invention of the steerable keel 10 is presented in terms of two embodiments. The first embodiment as shown in FIG. 1, is comprised of an upper stationary section 12 and a single lower rotatable section 14; the second embodiment, as shown in FIG. 3, is comprised of an upper stationary section 30 and two rotatable sections; a middle rotatable section 32 and a lower rotatable section 34. In both cases, the upper end of the stationary section 14, 32 is attached to a structural member of a sail boat 50 with the rotatable section(s) extending beyond the hull of the boat. Each of the rotatable section(s) are independently controlled from the deck of the boat by a steering tiller. Additionally, each embodiment of the steerable keel may be designed to be retracted, as shown in FIGS. 2 and 4, to allow the boat to dock and to navigate in shallow waters.

Figure 14:
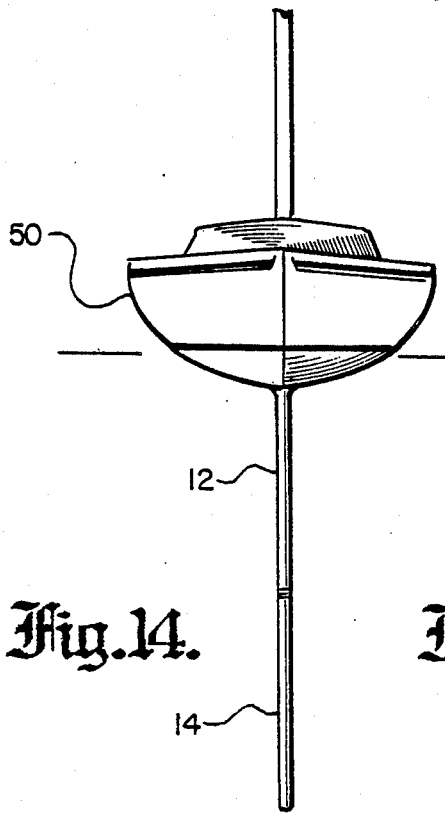
FIG. 14 is a front view of a sailing boat shown in a horizontal stabilized position.
Figure 15:
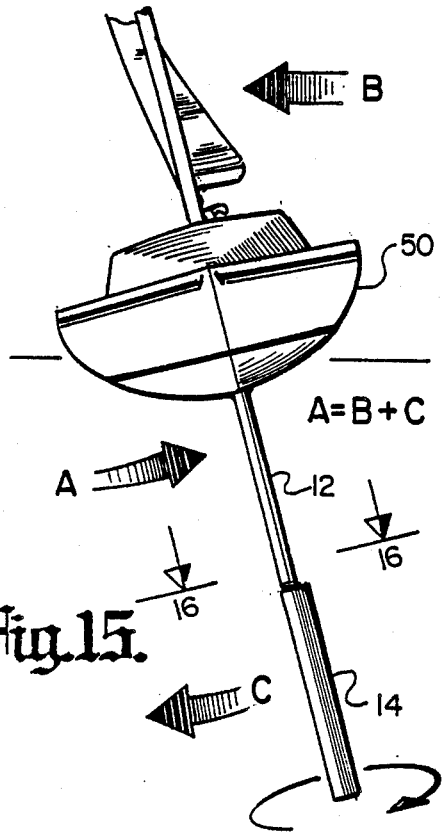
FIG. 15 is a front view of sailing boat heeling to one side and being compensated by the rotating steerable keel.
Figure 16:
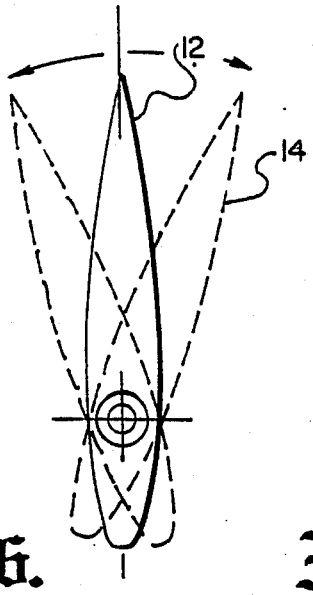
FIG. 16 is a top view of a steerable keel with a stationary upper section and a rotatable lower section displaced from the keel centerline.
Figure 17:
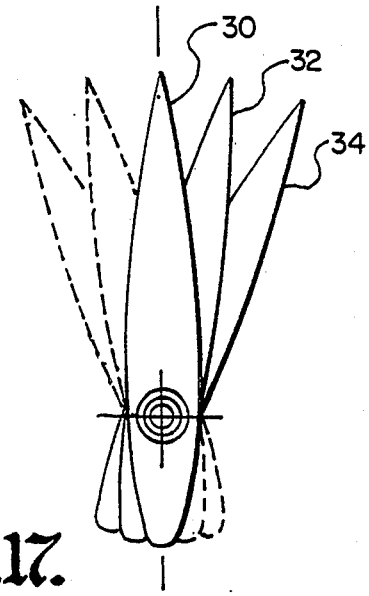
FIG. 17 is a top view of a steerable keel with a rotatable upper section and a rotatable lower section showing both sections displaced from the keel centerline.

The principal purpose of the steerable keel 10 is to provide an increase in speed by reasonable maintaining the beam of the boat in a horizontal plane with respect to the water surface as shown in FIG. 14. This is accomplished, as shown in FIG. 15, by attempting to equalize the wind force B (center of effort) and its counter force A (center of lateral resistance) with a controlled pulling force C, where $A=B+C$. The amount of pulling force C is controlled by rotating the single rotatable section, as shown in FIG. 16 through on 8 to 10 degree arc from the centerline; or by rotating the two rotatable sections 32, 34, as shown in FIG. 17, through a combination of arcs also in the 8 to 10 degree range.

Figures 9, 10, 11, 12:
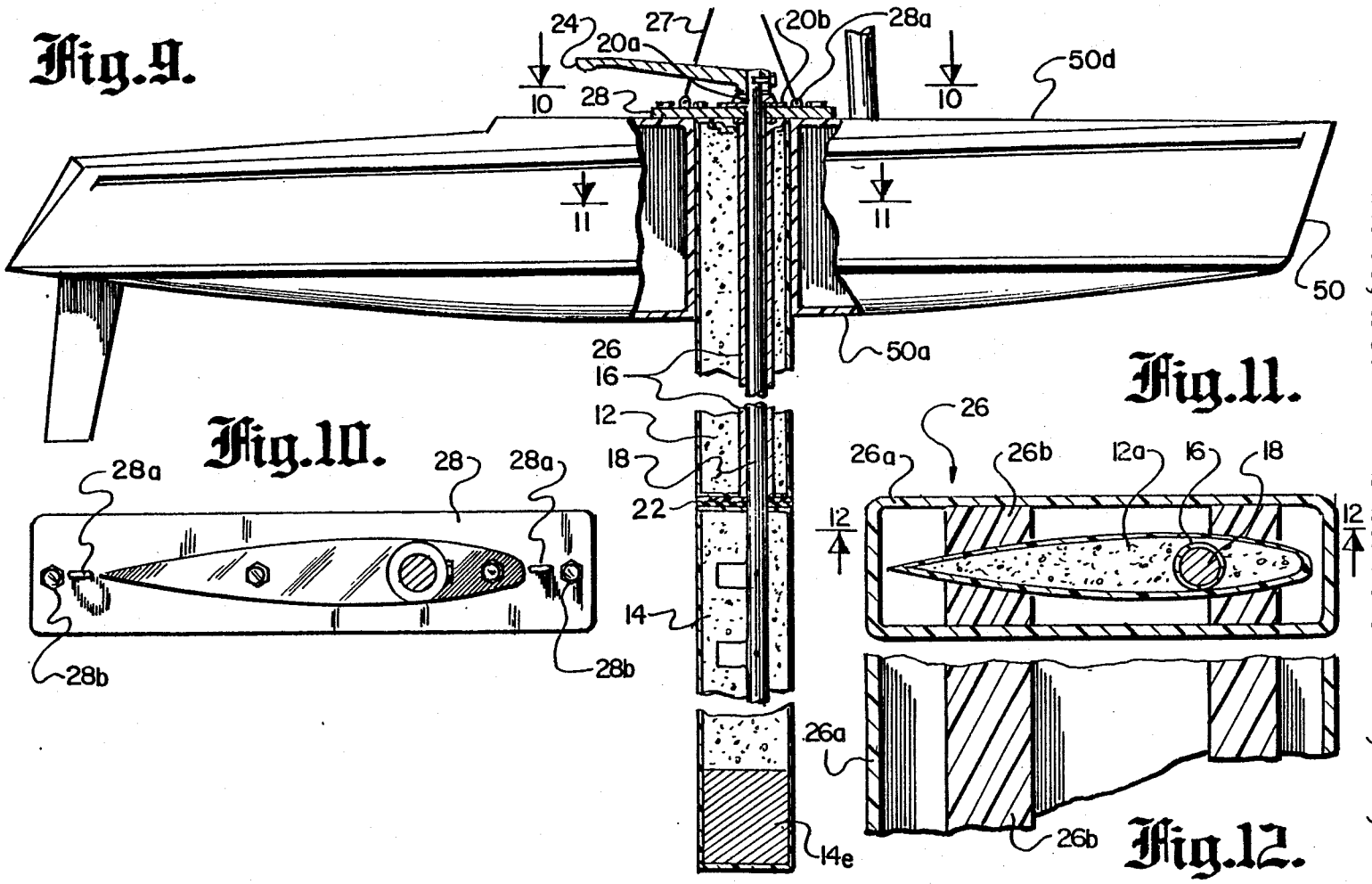
FIG. 9 is a cutaway side view of a typical retractable steering keel having an upper stationary section and a lower rotatable section.
FIG. 10 is a sectional view taken along lines 10—10 of FIG. 9.
FIG. 12 is a sectional view taken along lines 12—12 of FIG. 11.

The first embodiment of the steerable keel 10, as best shown in FIGS. 5 and 9, is comprised of seven major elements: an upper stationary section 12, a lower rotatable section 14, a steering tube bearing 16, a steering shaft 18, a keel mounting plate 20, a keel-to-keel water seal 22 and a steering tiller 24. The upper stationary section 12 may be totally constructed of metal such as stainless stell or preferably as shown in FIG. 6, of a close cell foam material **14*c* that is covered with an S-glass or E-glass type fiberglass 14*d*. The cross-sectional area of the keel, as shown in FIGS. 6, 7 and 8 is an aerodynamic fing such as an 18 percent NACA foil. Through the 35 percent chord line of the cross-section of the upper section 12 is a steering tube bore 12*c* that extends through the length of the section 12**.

In the preferred design the upper stationary section 12 has a typical width of 12 inches (30.48 cm) typical length that allows the section to protect a distance of 6 feet (1.83 meters) below the boat hull.

The upper section 12 is attached to the boat 50 by inserting the upper end **12*a* through a keel cavity 25 that extends through the hull 50*a*, bilge 50*b* and floor 50*c* of the boat as shown in FIG. 5. The keel mounting plate 20 is then attached over the top of the upper end 12*a* of the stationary section 12 and attached to the top of the boat floor 50*c*. The keel mounting plate 20 has a mounting plate steering tube bore 20*a* that is in alignment with the steering tube bore 12*c*. Over the top of the bore 20*a* is centrally located a mounting plate alignment bushing 20*b***.

After the upper stationary section 12 is secured within the keel cavity 25, the steering tube bearing 16 is inserted into the steering tube bore **12*c*. The bottom of the bearing 16 is flush with the lower end 12*b* of the stationary section 12 and the top of the bearing 16 extends beyond the upper end of the stationary section 12 through the mounting plate alignment bushing 20*a* and the deck alignment bushing 21 to a distance above the boat deck. An alternate method of attaching the steering tube bearing 16 to the stationary section 12 is to mold the stationary section 12 around the bearing 16**.

The lower rotatable section 14, as shown in a side view in FIG. 5, and in cross-section in FIGS. 7 and 8, is also preferably molded of foam **14*c* with an outer layer of fiberglass 14*d*. The rotatable section has the same cross-sectional shape and area as the stationary section 12 and has a preferred length of 6 feet (1.83 meters). Thus, the two sections 12, 14** when joined, have a total length of 12 feet (3.66 meters) and a width of 12 inches (30.48 cm).

The length and width of the steerable keel is determined by calculation: the overall keel length is equal to 40 percent of the distance between the top of the boat mast and the waterline. For example, a boat having a mast top to water line distance of 30 feet (9.14 meters) would require a steerable keel with a total length of 12 feet (3.66 meters). The keel width is determined by calculating the overall area of the keel. This overall area is selected to provide a form drag that approximately equals the drag of the boat.

At the bottom area of the rotatable section is embedded a lead weight **14*e* and a steering shaft 18 is embedded longitudinally in alignment with the steering tube bearing 16 in the stationary section 12. The shaft 18 includes, as shown in FIG. 5, a set of locking prongs 18*a* to assure that the shaft remains rigid within the rotatable section 12**.

The rotatable section 14 is rotatable attached to the stationary section 12 by inserting the steering shaft 18 into the steering tube bearing 16. The shaft 18 is inserted through the mounting plate alignment bushing **20*b* and the deck alignment brushing 21 to a distance above the boat deck to allow a steering tiller 24 to be rigidly attached to the shaft 18 as shown in FIG. 5**. The tiller includes a mechanism (not shown) that applies a friction torque or a lock to be applied to the steering shaft.

The final major element comprising the first embodiment is the keel-to-keel water seal 22 that prevents excessive water from entering the interface gap 23 between the bottom end of the stationary section 12 and the upper end of the rotable section 14. The sealing is accomplished by attaching a piece of resilient material **22*a* such as neoprene with a nylon outer covering to the lower end 12*b* of the upper stationary section 12 and to the uper end 14*a* of the lower rotatable section 14 where the two pieces are of sufficient thickness to fill the interface gap and allow the two sections 12, 14** to slideably rotate.

The interface between the upper end **12*a* of the upper stationary keel 12 and the boat hull 50*a* must also be water sealed. This is conventionally accomplished by packing the joint with a suitable water sealing compound 12*d*** and smoothing the surface to prevent water flow obstruction.

The retractable version of the steering keel 10 with a single rotatable section 14 is shown in a retracted position in FIG. 2 and in detail in FIG. 9. In this design the principal changes are in the length of the upper stationary section 12, the corresponding steering tube bearing 16 and the steering shaft 18, and in the method of attaching the steerable keel 10 to the boat deck 50*d*. Additionally, to accomplish the retractable feature the boat 50 must include a keel opening 26.

The retractable stationary keel 12 is identical with the stationary keel 12 with the exception that its length must be increased by a distance equal to the distance between the boat hull 50*a* and the boat deck 50*c*. Likewise, the length of the steering tube bore 12*c*, steering tube bearing 16 and the steering shaft are increased by a similar amount.

The keel opening 26 extends from the hull 50*a* to the deck 50*d* of the boat 50. Around the keel opening as best shown in FIG. 11, is structurally attached a frame structure 26*a* that has conventionally attached around its inside perimeter a crushing material 26*b* that slideably conforms to the cross-sectional shape of the steerable keel. The cushioning material 26*b* may completely surround the shape of the keel or may be applied in sections as shown in FIGS. 11 and 12.

The upper section 12 is attached to the boat deck 50*d* by inserting the upper end 12*a* through the keel opening 26 and over the boat deck. a retracting mounting plate 28, as shown in FIGS. 9 and 10 is then attached over the top of the upper end 12*a* of the stationary keel 12 and the plate is subsequently attached to the top of the boat deck 12*a*. As in the non-retracting design the retracting mounting plate 28*a* has a mounting plate steering tube bore 20*a* over which is attached an alignment bushing 20*b*. After the upper stationary section is secured, the rotatable section 14 is attached as previously described for the non-retracting design.

The retracting mounting plate 28 includes a set of eyelets 28*a* that are attached next to the deck bolts 28*b* as shown best in FIG. 10. To these eyelets, as shown in FIG. 9, may be fastened a lanyard that is routed through a set of pulleys (not shown). To retract the steerable keel, the deck bolts 28*b* are removed and the lanyard is pulled to bring the steerable keel over the boat deck 50*d* as shown in FIG. 2.

The second embodiment of the steerable keel 10, as best shown in FIG. 13 is comprised of ten major elements: an upper stationary section 30, a middle rotatable section 32, a lower rotatable section 34, a steering shaft 36, a steering tube 38, a steering tube bearing 40, a keel mounting plate 20, a keel-to-keel water seal 22, a first tiller 44 and a second tiller 46. The design/construction details of this steerable keel 10 are identical to those previously described for the first embodiment. Therefore, only the difference is described. Additionally, because of the length of the stationary keel 30, the mounting arrangement which utilizes a keel opening 26 serves for both a non-retracting and retracting steerable keel 10. The keel opening used in this design is also identical to that described for the retractable steering keel 10.

The upper stationary section 30 has a steering tube bearing bore 42 extending therethrough into which is inserted and rigidly attached a steering tube bearing 40 that has its ends flush with its upper end 30*a* and lower end 30*b*.

The stationary section 30 is attached to the boat deck 50*d* by attaching a keel mounting plate 20 that extends over the upper end 30*a* of the section 30 as shown in FIG. 13. The plate 20 is then attached to the top of the boat deck 50*d*. As in the previous discussion, the plate 20 includes a mounting plate steering tube bore 20*a* over which is attached an alignment bushing 20*b*.

The middle rotatable section 32 has a steering tube bore 37 extending therethrough into which is inserted and rigidly attached a steering tube 38. The bottom of the tube is flush with the bottom end 32*b* and the top of the tube 38 extends for a distance above the alignment bushing 20*b*. The upwardly projecting tube 38 is inserted through the steering tube bearing 40 and through the mounting plate alignment bushing 20*b*. The section 32 is held in place when the first tiller 44 is attached to the steering tube as shown in FIG. 13.

The lower rotatable section 34 has the steering shaft 36 embedded within the section 34 as shown in FIG. 13. The shaft 36 extends upwardly to a distance above the end of the steering tube 38. To rotatably attach the section 34 to the steering keel 10, the steering shaft 36 is inserted into and through steering tube 38. The shaft is held in place by the second tiller 46 as shown in FIG. 13. The two tillers operate independently from one another thus allowing the two rotatably sections 32, 34 to be independently rotated as shown in FIG. 17.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

I claim:

1. A steerable keel integral with a sailing boat comprising:

(a) a keel opening extending from the hull of said boat through the boat deck, where said keel opening includes a cushioning material, around its inside perimeter, that slideably conforms to the cross-sectional shape of said steerable keel, (b) an upper stationary section having an upper end and a lower end where the upper end is attached to the deck section of said boat by an attaching means and where lower end extends through said keel opening and beyond the hull of said boat, (c) a middle rotatable section having an upper end and a lower end where the upper end is rotatably attached to the lower end of said stationary section by an attaching means, (d) a lower rotatable section having an upper end and a lower end where the upper end is rotatably attached to the lower end of said middle rotatable section by an attaching means, (e) means to water seal the intersection between the lower end of said upper stationary section and the upper end of said middle rotatable section, (f) means to water seal the interface between the lower end of said middle rotatable section and upper end of said lower rotatable section, and (g) means to independently steer said middle rotatable section and said lower rotatable section.

2. The steerable keel as specified in claim 1 werein said means to attach the upper end of said upper stationary section of said keel to the deck of said boat is accomplished by attaching a keel mounting plate that extends over the top of the upper end of the upper stationary keel and the top of the boat deck with said mounting plate having a stationary steering tube bore therethrough on an alignment bushing conventionally attached over the top of the tube bore.

3. The steerable keel as specified in claim 1 with said upper stationary section further having a steering tube bearing bore extending therethrough into which is inserted and rigidly attached a steering tube bearing where ends of said bearing are flush with the upper end and lower end of said upper stationary section.

4. The steerable keel as specified in claim 1 with said middle rotatable section further having a steering tube bore extending therethrough into which is inserted and rigidly attached a steering tube where bottom of said tube is flush with the bottom end of said middle rotatable section and upper end of said tube extends above the upper end of said upper stationary section.

5. A steerable keel integral with a sailing boat comprising:

(a) keel opening extending from the hull of said boat through the boat deck, where said keel opening includes a cushioning material, around its inside perimeter, that slideably conforms to the cross-sectional shape of said steerable keel, (b) an upper stationary section having an upper end and a lower end where the upper end is attached to the deck section of said boat by an attaching means and where lower end extends through said keel opening and beyond the hull of said boat, (c) a middle rotatable section having an upper end and a lower end where the upper end is rotatably attached to the lower end of said stationary section by an attaching means, (d) a lower rotatable section having an upper end and a lower end where the upper end is rotatably attached to the lower end of said middle rotatable section by an attaching means, and further having a steering shaft embedded within said lower rotatable section that extends upwardly to a distance above the upper end of said upper stationary section, (e) means to water seal the intersection between the lower end of said upper stationary section and the upper end of said middle rotatable section, (f) means to water seal the interface between the lower end of said middle rotatable section and upper end of said lower rotatable section, and (g) means to independently steer said middle rotatable section and said lower rotatable section.

6. The steerable keel as specified in claim 1 further comprising a section of resilient material attached to each of the interfacing ends of said upper stationary section and said middle rotatable section and each of the interfacing ends of said middle rotatable section and lower rotatable section where the thickness of said material slideably fills the interface gap between each of the two keel sections.

7. The steerable keel as specified in claim 1 wherein the means to independently steer said middle rotatable section and said lower rotatable section from the deck of said boat is accomplished by said first steering tiller and said second steering tiller respectively.

8. The steerable keel as specified in claim 1 further comprising steerable keel retracting means that allows said keel to be retracted through the hull and over the deck of said boat.

9. The steerable keel as specified in claim 1 wherein said retracting means is accomplished by securing a lanyard to the top of said keel mounting plate where lanyard is placed over a pulley attached to the mast of said boat such that when said mounting plate is loosened from the boat deck the keel, attached to the mounting plate can be retracted by pulling on the lanyard.

10. The steerable keel as specified in claim 1 wherein said keel cross-section resembles an aerodynamic fin.

11. A steerable keel integral with a sailing boat comprising:

(a) a keel opening extending from the hull of said boat through the boat deck, where said keel opening includes a cushioning material, around its inside perimeter, that slideably conforms to the cross-sectional shape of said steerable keel, (b) an upper stationary section having an upper end and a lower end where the upper end is attached to the deck section of said boat by an attaching means and where lower end extends through said keel opening and beyond the hull of said boat, with said upper stationary section further having a steering tube bearing bore extending therethrough into which is inserted and rigidly attached a steering tube bearing where ends of said bearing are flush with the upper end lower end of said upper stationary section, (c) a middle rotatable section having an upper end and a lower end an further having a steering tube bore extending therethrough into which is inserted and rigid attached a steering tube where bottom of said tube is flush with the bottom end of said middle rotatable section and upper end of said tube extends above the upper end of said upper stationary section, (d) a lower rotatable section having an upper end and a lower end and further having a steering shaft embedded within said lower rotatable section that extends upwardly to a distance above the upper end of said upper stationary section where said lower rotatable section is attached to said middle rotatable section and said middle rotatable section is attached to said upper stationary section when said steering tube is inserted into said steering tube bearing and said steering shaft is inserted into said steering tube, where said middle rotatable section and said lower rotatable section are held in place by a first steering tiller located around said steering tube and a second steering tiller located around said steering shaft, where said first and second steering tillers serve to independently steer said middle rotatable section and said lower rotatable section, (e) means to water seal the intersection between the lower end of said upper stationary section and the upper end of said middle rotatable section, and (f) means to water seal the interface between the lower end of said middle rotatable section and upper end of said lower rotatable section.

12. A steerable keel integral with a sailing boat comprising:

(a) a keel opening extending from the hull of said boat through the boat deck, where said keel opening includes a cushioning material, around its inside perimeter, that slideably conforms to the cross-sectional shape of said steerable keel, (b) an upper stationary section having an upper end and a lower end where the upper end is attached to the deck section of said boat by an attaching means and where lower end extends through said keel opening and beyond the hull of said boat, (c) a middle rotatable section having an upper end and a lower end where the upper end is rotatably attached to the lower end of said stationary section by an attaching means, (d) a lower rotatable section having an upper end and a lower end where the upper end is rotatably attached to the lower end of said middle rotatable section by an attaching means, (e) a section of resilient material attached to each of the interfacing ends of said upper stationary section and said middle rotatable section and each of the interfacing ends of said middle rotatable section and lower rotatable section where the thickness of said material slideably fills an interface gap present between each of the two keel sections, (f) a resilient sleeve inserted across the interface gap between said upper stationary section and said middle rotatable section and between said middle rotatable section and lower rotatable section where the combination of the resilient material between the interfacing gaps and the resilient sleeves provides the means to water seal the interfacing gaps, and (g) means to independently steer said middle rotatable section and said lower rotatable section.

13. A steerable keel integral with a sailing boat comprising:

(a) an upper stationary section having an upper end and a lower end where the upper end is rigidly attached to the bottom section of said boat by an attaching means, (b) a lower rotatable section having an upper end and a lower end where the upper end is rotatably attached to the lower end of said upper stationary section by an attaching means, (c) means to water seal the interface gap between the lower end of said upper stationary section and the upper end of said lower rotatable section, (d) means to steer said lower rotatable section from the deck of said boat, and (e) a retracting means that allows said steerable keel to be retracted through the hull and over the deck of said sailing boat wherein said retracting means comprises:

(1) said sail boat having a keel opening that extends from the boat hull through the boat deck where around the keel opening is located a frame structure having attached around its inside perimeter a cushioning material that slideably conforms to the cross-sectional shape of said steerable keel, (2) an upper stationary having an upper end and a lower end where upper end is flush with the deck of said boat and lower end extends through said keel opening and beyond the hull of said boat, and (3) a keel mounting plate attached to the upper end of said keel and that extends over the ends of said keel and over the top of the boat deck where on the top of said plate is secured a lanyard that is placed over a pulley attached to the mast of said boat such that when said mounting plate is attached to the boat deck the keel is in its non-retracted position and when said mounting plate is loosened from the boat deck, the keel can be retracted by pulling on the lanyard.

14. A steerable keel integral with a sailing boat comprising:

(a) an upper stationary section having an upper end and a lower end where the upper end is rigidly attached to the bottom section of said boat by an attaching means, (b) a lower rotatable section having an upper end and a lower end where the upper end is rotatably attached to the lower end of said upper stationary section by an attaching means, (c) a piece of resilient material attached to the lower end of said upper stationary section and a piece of resilient material attached to the upper end of said lower rotatable section where the thickness of said material slideably fills an interface gap between the two keel sections, (d) a resilient sleeve inserted across the interface gap between said lower rotatable section and said upper stationary section where the combination of the resilient material between the interface gap and the resilient sleeve provides the means to water seal the interface gap, and (e) means to steer said lower rotatable section from the deck of said boat.

15. A steerable keel integral with a sailing boat comprising:

(a) an upper stationary section having an upper end and a lower end where the upper end is rotatably attached to the lower end of said upper stationary section by an attaching means, (b) a lower rotatable section having an upper end and a lower end where the upper end is rotatably attached to the lower end of said upper stationary section by an attaching means, (c) a piece of resilient material attached to the lower end of said upper stationary section and a piece of resilient material attached to the upper end of said lower rotatable section where the thickness of said material slideably fills the interface gap between the two keel sections, and (d) means to steer said lower rotatable section from the deck of said boat.

16. A steerable keel integral with a sailing boat comprising:

(a) an upper stationery section having an upper end and a lower end and having a steering tube bore extending therethrough into which is inserted a steering tube bearing where said bearing is flush with the lower end of said stationery section and the upper end extends beyond the upper end of said stationery section to a distance above the deck of said boat, (b) a lower rotatable section having an upper end and a lower end where the upper end is rotatably attached to the lower end of said upper stationary section by an attaching means, (c) means to water seal the interface gap between the lower end of said upper stationary section and the upper end of said lower rotatable section, and (d) means to steer said lower rotatable section from the deck of said boat.

* * * * *